US007004133B1

(12) United States Patent
Smoron

(10) Patent No.: US 7,004,133 B1
(45) Date of Patent: Feb. 28, 2006

(54) WIRE HARNESS ASSEMBLY FOR PRODUCING HIGH VISIBILITY GLOW IN AUTOMOBILES

(76) Inventor: Chris Smoron, 302 7th St., LaSalle, IL (US) 61301

( * ) Notice: Subject to any disclaimer, the term of this patent is extended or adjusted under 35 U.S.C. 154(b) by 0 days.

(21) Appl. No.: 11/064,105

(22) Filed: Feb. 23, 2005

(51) Int. Cl.
*F02P 23/00* (2006.01)

(52) U.S. Cl. ..... 123/143 C; 174/19

(58) Field of Classification Search ..... 123/143 C, 123/594, 145 A; 174/19, 24, 17 R
See application file for complete search history.

(56) References Cited

U.S. PATENT DOCUMENTS 4,306,187 A * 12/1981 Kinder ..... 324/395
2003/0164646 A1 * 9/2003 Tooke ..... 307/150
2005/0094408 A1 * 5/2005 Alexander ..... 362/473

* cited by examiner

*Primary Examiner*—Mahmoud Gimie
(74) *Attorney, Agent, or Firm*—Goldstein Law Offices, PC.

(57) ABSTRACT

A wire harness assembly for producing a high visibility glow within an automobile vehicle having an ignition coil, a pair of spark plugs, a distribution panel, and a power adapter. The distribution panel has terminals and is connected in series between the ignition coil and the spark plugs. A battery is connected to the distribution panel. A plurality of spark plug wires extend from the spark plug boots through the power adapter to the spark plugs, and include an outer magnified clear casing and one elongated neon strip extending throughout the casing. A power adapter is connected in series by a cable between the ignition coil and the terminals and includes two channels for accepting the spark plug wires therein and at least two metal tabs on the channels for supplying power through the metal tabs to the neon strip.

3 Claims, 2 Drawing Sheets

WIRE HARNESS ASSEMBLY FOR PRODUCING HIGH VISIBILITY GLOW IN AUTOMOBILES

BACKGROUND OF THE INVENTION

The invention relates to a wire harness and more particularly, to a wire harness assembly for producing a high visibility glow each time current is supplied within an automobile having a distribution panel connected in series between an ignition coil of an automobile vehicle and spark plugs.

Most motorists take pride in their vehicles and spend money on items used to enhance the appearance of their vehicles. Many cars produce a distinctive engine sound that conveys a sense of power waiting to be unleashed. There is much that can be done to improve the appearance of an engine, which many car aficionados would enjoy.

U.S. Pat. No. 3,596,174 to Hovenga discloses an initiation tester having a neon bulb that is connected to the high voltage spark plug wire. U.S. Pat. No. 6,293,687 to Poirot discloses an indicator using light emitting diodes for a circuit in a motor vehicle. U.S. Pat. No. 6,596,942 to Ito discloses a color arrangement for wires in a vehicle.

While these units may be suitable for the particular purpose employed, or for general use, they would not be as suitable for the purposes of the present invention as disclosed hereafter.

SUMMARY OF THE INVENTION

It is an object of the invention to produce a high visibility glow each time current is supplied to the spark plugs within a vehicle. Accordingly, the invention is a wire harness assembly and a distribution panel connected in series between an ignition coil of an automobile vehicle and spark plugs, for producing a high visibility glow through a neon strip each time current is supplied to the spark plugs.

It is another object of the invention to provide a means for supplying power to the neon strip. Accordingly, the invention includes a power adapter having channels having metal tabs thereon for accepting the spark plug wires therein and supplying power to the neon strips.

This invention is a wire harness assembly for producing a high visibility glow within an automobile vehicle having an ignition coil, a pair of spark plugs, a distribution panel, and a power adapter. The distribution panel has terminals and is connected in series between the ignition coil and the spark plugs. A battery is connected to the distribution panel. A plurality of spark plug wires extend from the spark plug boots through the power adapter to the spark plugs, and include an outer magnified clear casing and one elongated neon strip extending throughout the casing. A power adapter is connected in series by a cable between the ignition coil and the terminals and includes two channels for accepting the spark plug wires therein and at least two metal tabs on the channels for supplying power through the metal tabs to the neon strip.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
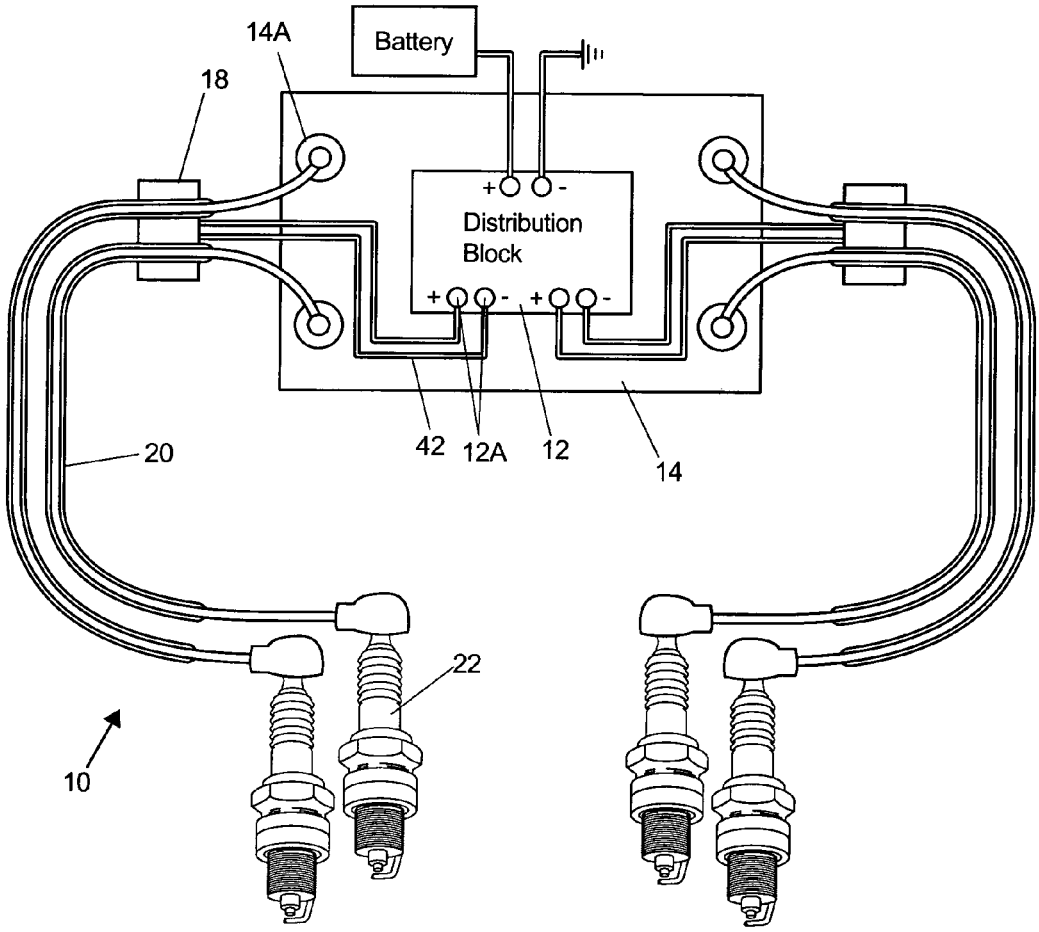
FIG. 1 is a top plan view of a wire harness assembly of the present invention, wherein a distribution panel, having terminals, is connected in series between an ignition coil of an automobile vehicle and spark plugs.

FIG. 1 illustrates a wire harness assembly 10 of the present invention for producing a high visibility glow each time current is supplied to a pair of spark plugs. A distribution panel 12, having terminals 12A, is connected in series between an ignition coil 14 of an automobile vehicle and the spark plugs 16. The ignition coil 14 includes spark plug boots 14A and generates high voltage required to create a spark. A power adapter 18 is connected in series by a cable 42 between the ignition coil 14 of the automobile and the terminals 12A of the distribution panel 12. A battery 40 is connected to the distribution panel 12. A plurality of spark plug wires 20 extend from the spark plug boots 14A through the power adapter 18 and to a spark plug 22. The ignition coil 14 is preferably a high voltage transformer made up of two coils of wire, a primary coil and a secondary coil. The secondary coil is wrapped around the primary coil and current flows from the battery 40 through the coils. Voltage supplied by the ignition coil 14 to the distribution panel 12 is connected to the terminals 12A by the cables 42 attach thereto.

Figure 2:
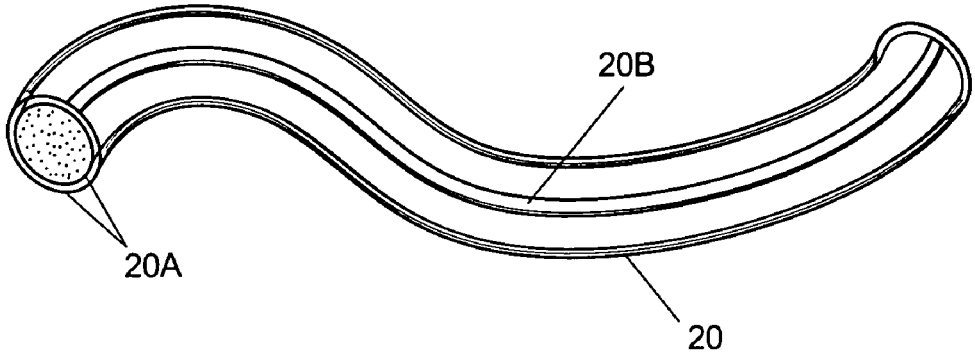
FIG. 2 is a diagrammatic perspective view of a spark plug wire of the wire harness of the present invention, having an outer magnified clear casing and an elongated neon strip therein.

FIG. 2 illustrates the spark plug wires 20 of the present invention. The spark plug wires 20 include an outer magnified clear casing 20A and one elongated neon strip 20B extending throughout the casing 20A. The neon strip 20B receives current and illuminates causing the automobile spark plug wires 20 to produce a high visibility glow.

Figure 3:
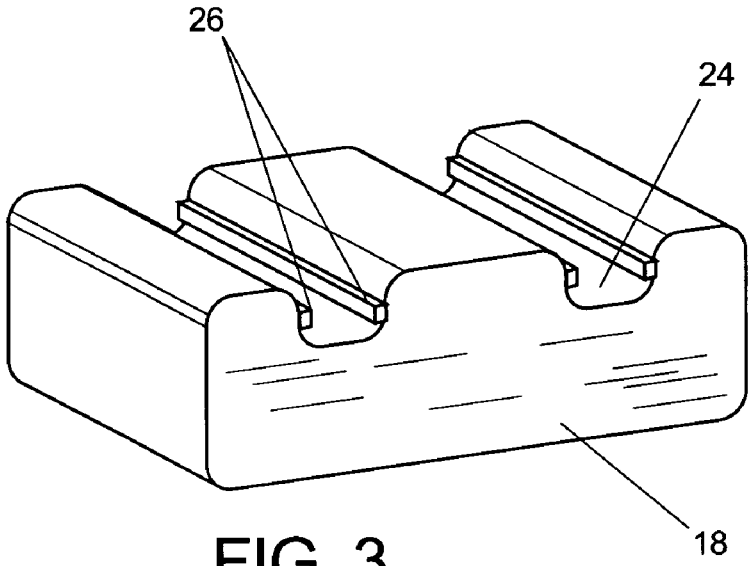
FIG. 3 is a cross-sectional view of the power adapter of the present invention for supplying power to the neon strips on the spark plug wires.

FIG. 3 illustrates the power adapter 18 of the invention. The power adapter 18 includes two channels 24 for accepting the spark plug wires 20 therein, and at least two metal tabs 26 on the channels 24. The metal tabs 26 contact the outer magnified clear casing 20A and supply power to the neon strip 20B of the spark plug wire 20. This allows the neon strip 20B to illuminate.

Referring to FIG. 1, the user is able to produce a high visibility glow with an engine of the automobile using the wire harness assembly 10 of the invention. A very high voltage of electricity is supplied to the spark plugs 22 in order to travel across a spark plug gap and create a good spark. Voltage at the spark plugs 22 is approximately 40,000 to 100,000 volts. The neon strips 20B illuminate within the spark plug wires by accepting power through the metal tabs 26 of the power adapter 18 to produce current within the neon strip 20B. As the spark plug wires 20 are covered by the casing 20A current within the neon strip 20B produces a visible glow each time the spark plug 14A is ignited. The sequence of lighting varies with each automobile to produce a constantly changing light pattern, enabling users to view a light show within their automobile. In additional embodiments, automobiles are equipped with transparent hoods to allow others to admire the visual effects created by the wire harness assembly 10.

In conclusion, herein is presented a wire harness assembly. The invention is illustrated by example in the drawing figures, and throughout the written description. It should be understood that numerous variations are possible, while adhering to the inventive concept. Such variations are contemplated as being a part of the present invention.

What is claimed is:

1. A wire harness assembly for producing a high visibility glow within an automobile vehicle, comprising:

an ignition coil, including a high voltage transformer, having spark plug boots for generating high voltage, having two coils of wire including a primary coil and a secondary coil, said secondary coil being wrapped around the primary coil;

a pair of spark plugs;

a distribution panel having terminals and being connected in series between the ignition coil of the automobile vehicle and the spark plugs;

a cable;

a battery being connected to the distribution panel;

a plurality of spark plug wires extending from the spark plug boots through the power adapter to the spark plugs, including an outer magnified clear casing and one elongated neon strip extending throughout the casing; and a power adapter being connected in series by the cable between the ignition coil and the terminals and including two channels for accepting the spark plug wires therein and at least two metal tabs on the channels for supplying power through the metal tabs to the neon strip.

2. A wire harness assembly for producing a high visibility glow within an automobile vehicle having an ignition coil having spark plug boots, spark plugs, a distribution panel in series between the ignition coil of the automobile vehicle and the spark plugs, and a power adapter including at least one channel and metal tabs within the channel for supplying power, comprising:

a plurality of spark plug wires having an outer magnified clear casing and one elongated neon strip extending throughout the casing, said wires extending from the spark plug boots through the channels of the power adapter to the spark plugs and accepting power supplied through the metal tabs of the power adapter to illuminate the neon strip.

3. A method of producing a high visibility glow with an engine of an automobile using a wire harness assembly having an ignition coil, a distribution panel, cables, spark plugs, a power adapter having channels having metal tabs, spark plug wires having neon strips therein, the steps comprising:

supplying a high voltage of electricity to the spark plugs by delivering voltage by the ignition coil through the power adapter to the distribution panel through the cables attach thereto; and illuminating the neon strips within the spark plug wires by accepting power through the metal tabs of the power adapter to produce current within the neon strip.

* * * * *